299-13 SR
4/23/85 OR 4,512,610

United States Patent [19]

Gilbert et al.

[11] Patent Number: 4,512,610

[45] Date of Patent: Apr. 23, 1985

[54] MINING SYSTEM

[75] Inventors: Clark J. Gilbert, Golden, Colo.; Menelaos D. Hassialis, Ridgewood, N.J.; Andrew H. Scrymgeour, Parker; Samuel I. Vera, Golden, both of Colo.

[73] Assignee: Mobil Oil Corporation, New York, N.Y.

[21] Appl. No.: 499,040

[22] Filed: May 27, 1983

[51] Int. Cl.[3] ..... E21C 41/00

[52] U.S. Cl. ..... 299/13; 299/19; 299/11

[58] Field of Search ..... 299/13, 19, 11, 12; 98/50

[56] References Cited

U.S. PATENT DOCUMENTS

| | | | |
|---|---|---|---|
| 1,842,664 | 1/1932 | Elsing | 299/13 |
| 3,537,753 | 11/1970 | Arendt | 299/13 |
| 3,897,107 | 7/1975 | Haglund | 299/13 |

FOREIGN PATENT DOCUMENTS

| | | | |
|---|---|---|---|
| 589400 | 1/1978 | U.S.S.R. | 299/19 |
| 640031 | 12/1978 | U.S.S.R. | 299/19 |
| 687232 | 9/1979 | U.S.S.R. | 299/19 |

OTHER PUBLICATIONS

*Mining Engineer's Handbook* vol. I, Peele, 3rd ed. pp. 6–12.

*Primary Examiner*—Stephen J. Novosad
*Assistant Examiner*—Mark J. DelSignore
*Attorney, Agent, or Firm*—A. J. McKillop; Michael G. Gilman; Frank J. Kowalski

[57] ABSTRACT

This system develops an ore body in two lifts, driven from opposite ends (at different times) and utilizes the concept of lane pillars rather than square block pillars. These conditions generate a new ventilation system that is flexible and well suited for the varying air requirements in oil shale mining.

The ore handling system is load-haul-dump (LHD) to portable crushers to belts to surface. The layout of this method introduces unique functions for this system by creating two directional ore flow from the workings, which optimize logistics and material handling methods.

5 Claims, 7 Drawing Figures

MINING SYSTEM

BACKGROUND OF THE INVENTION

Oil shale represents a vast untapped resource of liquid hydrocarbon fuel; potentially, it could be a source for a synthetic fuel substitute to replace the ever-diminishing supply of domestic petroleum. There are over 2 trillion barrels of synthetic fuels locked up in oil shale deposits in the United States. Oil shale occurs in zones up to several hundred feet thick but typically the richest zone is from 50–100 feet thick. The oil shale is found in the rock in the form of kerogen, a high molecular weight hydrocarbonaceaous material. Heating oil shale in a device termed a reort results in the decomposition of the kerogen and formation of the liquid known as shale oil. Oil shale retorting can be carried out in situ, that is in place in the ground, or it can be carried out in a process facility on the surface. In order to carry out retorting on the surface, it is necessary to mine the ore. The most commonly proposed technique to carry out the mining of oil shale has been the room and pillar method as illustrated in FIG. 1.

The room and pillar method is discussed in Chapter 5 of "An Assessment of Oil Shale Technologies", by the Office of Technology Assessment (June 1980) and in "Oil Shale Mining—Present and Future" by R. B. Crookston and D. A. Weiss taken from "Symposium Papers, Synthetic Fuels from Oil Shale II", Nashville Tenn. Oct. 26–29, 1981, Institute of Gas Technology, p. 417.

In the room and pillar design, the deposit is blocked into mining panels having a panel entry area 10 which may range from 900 to 1500 feet wide. Rooms 14 which are approximately 60 feet wide, the depth of a panel and the height of the mining zone are mined between the rooms leaving a pattern of square pillars 18 from 65 feet to 90 feet on a side to support the roof. Barrier pillars 19 are 65 feet in width but 400 feet in length to separate the panels to assure any pillar failure within a panel will not progress beyond the limits of the panel. Given dimensions vary with the quality of the rock and the depth of the overburden.

The panels are mined in three separate and distinct operations: heading extraction, bench extraction and crosscut extraction. Within the panel the upper extraction, termed the heading, about one-third to one-half of the height of the mining zone is driven within the boundaries of rooms and just below the roof (the top of the mining zone). When the headings are sufficiently advanced, the floor of the heading, i.e., the lower portion of the mining zone is mined. This operations called benching, ranges in depth but averages from one-half to two-thirds of the mining horizon. Benching is advanced in the same direction as the heading. While some crosscuts are taken during the heading advance, most are executed after the benching operation is completed.

The mining consists of several tasks; namely, drilling the blastholes, charging blastholes with explosives, blasting, water application to suppress dust, scaling down the loose rock, loading out the broken rock into trucks and hauling it to the crusher, and supporting the roof with steel rock bolts.

The broken rock in the dump trucks is hauled to a stationary crusher (not shown) located near a slope conveyor in panel entry 10. The shale is crushed and conveyed to the surface via the slope conveyor. Haulage by means of trucks presents a number of safety and logistical problems. The trucks exiting from the panel must traverse a ramp 12 from the heading or bench entries to panel entry 10. Because of the steep grade on ramp 12, the trucks will be subjected to substantial wear. In addition, the steep and narrow ramps 12 will tend to cause frequent accidents. Further, a significant logistical problem can occur at the crusher if the trucks do not arrive on schedule. Trucks off schedule could cause queuing of the rocks at the crushers, resulting in loss of efficiency and productivity.

The heading and benching operations produce oil shale of substantially different grade. In order to maintain constant grade of ore to the retort, the ore must be delivered to the crusher on a preset schedule. For example, in the case of the room and pillar mine discussed above, for every truck from the heading area one or two trucks should come from the bench mining area. In view of the numerous possibilities for delay in arrival of the truck e.g., mechanical breakdown, accidents, unavailability of ore, etc., the use of trucks for haulage of oil can result in frequent failure to maintain a constant grade of oil shale to the retorts. In addition, if the mine is deemed gassy, special requirements relating to mining equipment apply. At present, the large scale trucks required for oil shale haulage are not commercially available for use in gassy mines and would have to be specially fabricated to operate in a gassy mine.

An additional difficulty with a room and pillar mine layout is in the ventilatio requirements. Ventilation may be accomplished by drawing air in one side of the room and pillar design and exhausting out the other. Because of the numerous crosscuts present, proper ventilation becomes virtually impossible. As a result, it is necessary to use numerous curtains or brattices (not shown) to direct the air into rooms where the mining is taking place and close off those areas not undergoing mining. Because the proper seal of the opening is difficult to achieve, these brattices have a tendency to leak. Therefore, while proper ventiltion can thereby be achieved, a substantial amount of power still must be used. The presence of numerous crosscuts results in the need to utilize substantial quantities of power to maintain proper airflow.

Support of the roof of underground mines is an important and expensive procedure. To prevent collapse of portions of the roof, the room and pillar must be designed to withstand the pressure of the rock above and the suspended weight of the roof over the room opening. At an intersection 20 of a room 14 and a crosscut 16, this problem becomes more substantial due to the locally large spans produced by the intersections of crosscut and room tends to be weaker and requires additional maintenance. Minimizing crosscuts would reduce these maintenance costs and decrease the safety risks.

SUMMARY OF THE INVENTION

The present invention solves the foregoing problems of mining such as ventilation requirements, ramp access, extensive overhead support restrictions and safety hazards by providing a multilayered mining system and a modified layout of pillars and rooms. Parallel entries, and bench or lower entry and heading or upper entry, are mined perpendicularly to a main entry. Lanes, or rooms, driven perpendicularly to the heading entry are completed to a predetermined distance from the bench entry. A stub is driven from the bench entry toward the heading entries. The two levels are connected by driving a vertical slot raise to create a bench face. Oil shale is mined from the bench face and from the heading level. Portable crushers are located in an adjacent entry to receive oil shale from load-haul-dumps for placement on entry conveyors. The entry conveyors transport crushed oil shale to a primary conveyor in the main entry for transportation to the surface for further processing.

DESCRIPTION OF THE PREFERRED EMBODIMENT

Figure 1:
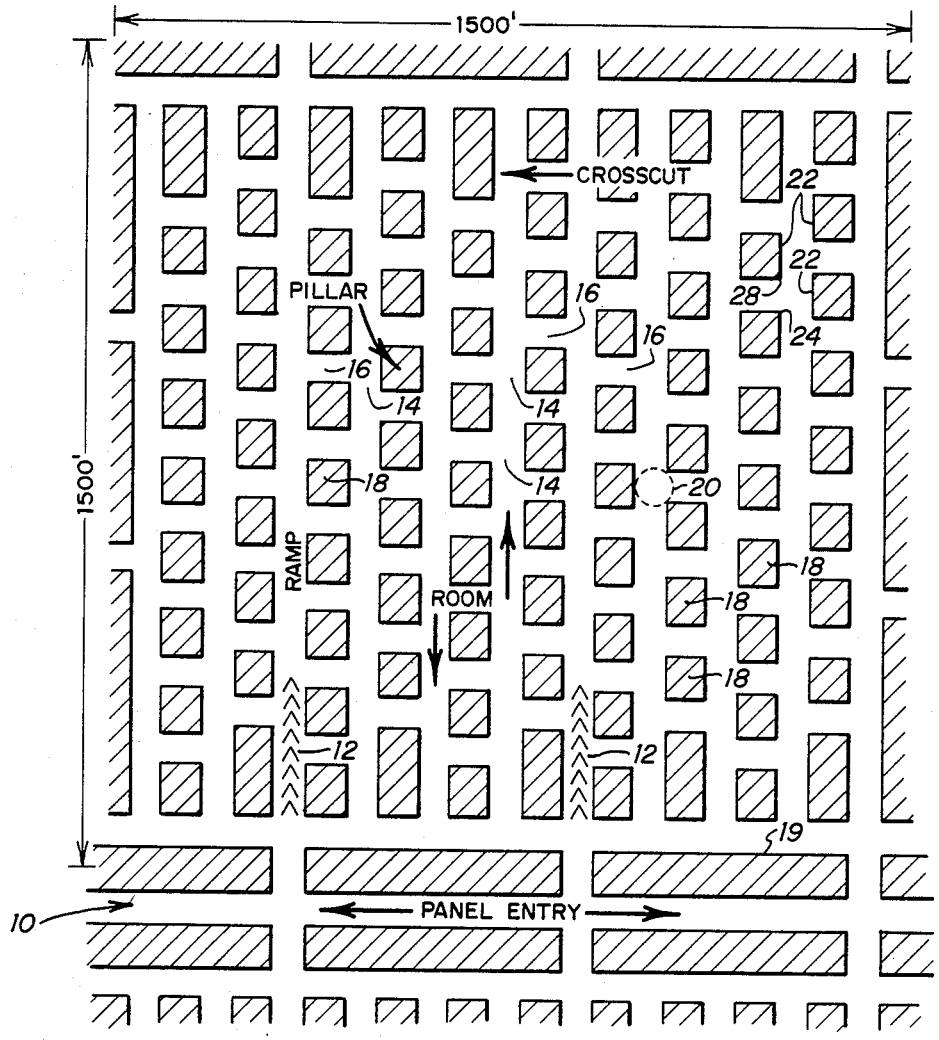
PRIOR ART FIG. 1
FIG. 1 is a plan view of a room and pillar mining operation.
Figure 2:
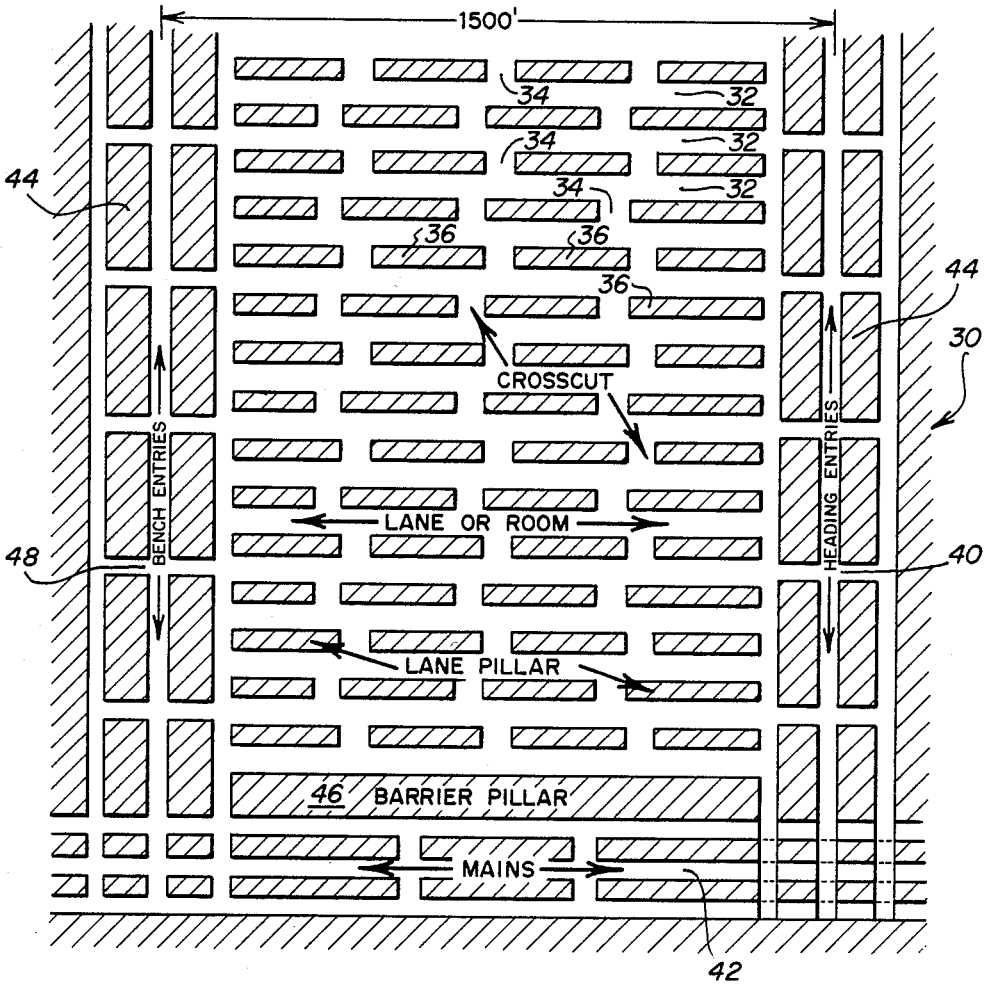
FIG. 2 is a plan view of a lane and pillar mining operation.

Referring to FIG. 2, a land and pillar design 30 of the present invention is illustrated as having lane 32 and crosscuts 34 defining pillars 36. One end of lane 32 is terminated by bench entry 38 and the other end is terminated by heading entry 40. Bench entry area 38 and heading entry area 40 are formed perpendicular to main entry area 42 with wide support pillars 44, a barrier pillar 46 isolates main entry area 42 from the mining area defined by lanes 32 and crosscuts 34 supported by pillars 36.

Main entry area 42 is mined or excavated followed by mining heading entry 40 and bench entry 38. A lane 32 is mined from heading entry 40 to a location prior to bench entry 38 at a level equal to that of heading entry 40. Lane 32 is completed from bench entry 38.

Figures 3A, 3B, 3C, 3D:
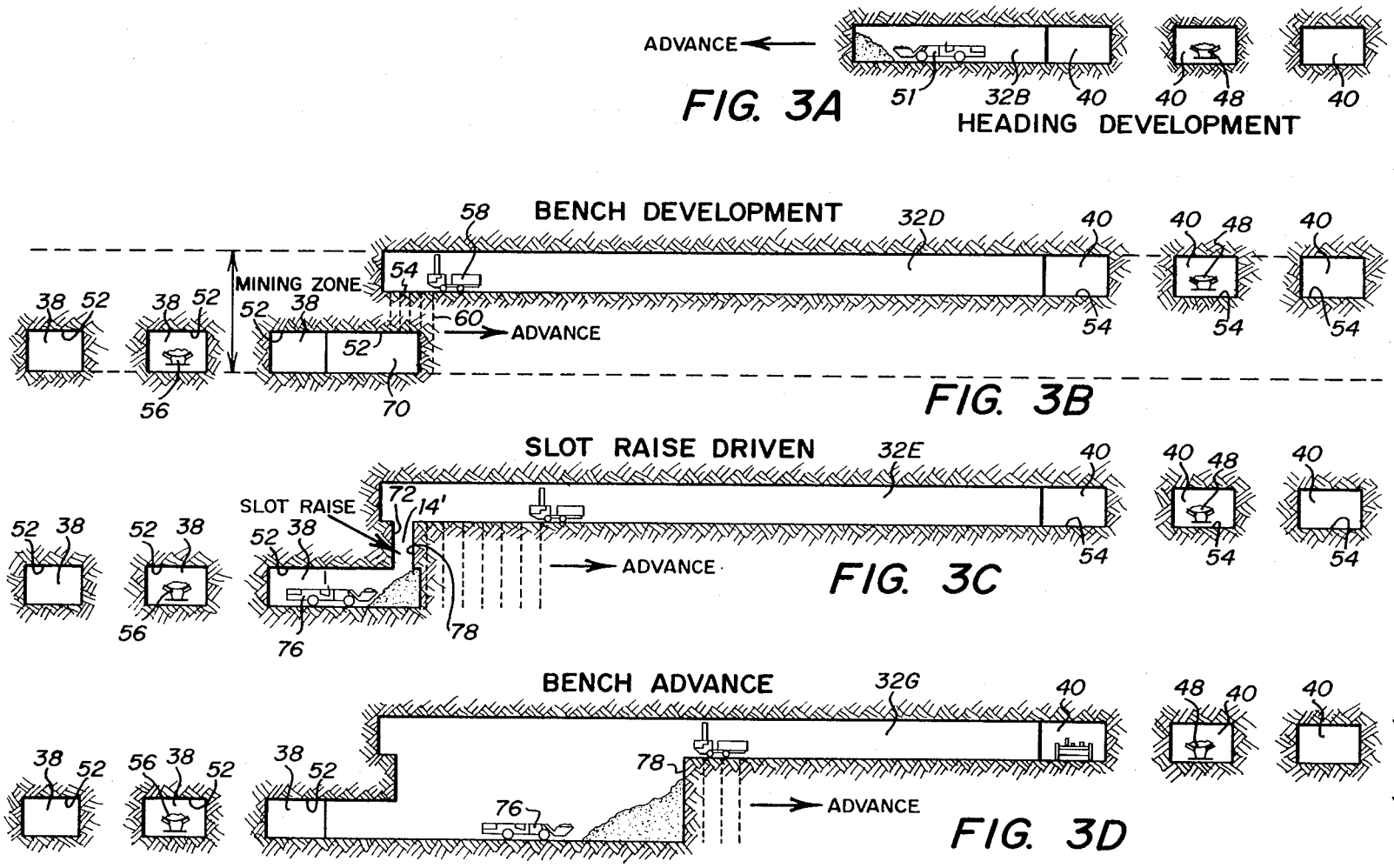
FIGS. 3A and 3D are side view of FIG. 2.

FIG. 3A illustrates a completion of heading entry 40 and the commencement of mining a lane. A conveyor belt 48 is located in one of heading entry 40 tunnels. In the preferred embodiment heading entry 40 comprises three tunnels with conveyor 48 located in the center tunnel to provide access from either side. However, any number of tunnels may be used and conveyor 48 has access to a conveyor belt 50 (See FIG. 4) in main entry area 42.

As lane 32 is mined, a load-haul-dump vehicle 51 transports mined material to portable crusher then to conveyor 48 for transportation to conveyor belt 50 in main entry area 42.

FIG. 3B illustrates the completion of lane 32 along with the start of bench entry 38. Heading entry 40 and bench entry 38 are each approximately twenty-five feet high with a vertical separation approximately twenty-five feet between the roof 52 of bench entry 38 and the floor 54 of heading entry 40. Bench entry 38 comprises three tunnels having a conveyor 56 located in the center tunnel in the preferred embodiment. However, as stated in conjunction with heading entry 40, bench entry may be of any number of tunnels and conveyor 56 may be located in any tunnel as long as one end of conveyor has provision to load mined materials on conveyor belt 50 in main entry 42.

A drilling vehicle 58 is illustrated as drilling through the floor of lane 32 to the ceiling level of bench stub 70 off bench entry 38. A ledge extends out from the end of surface of lane 32 nearest bench entry 38.

The holes between bench stub 70 and the upper portion of lane 32 are blasted to provide a slot raise 74 as illustrated in FIG. 3C. Similar to removal of mined material from the upper portion of lane 32, load-haul-dump vehicle 76 transports mined material from a bench face 78 to a portable crusher which loads onto conveyor 56.

Referring now to FIG. 3D, advancement of bench mining operations is illustrated. Bench face 78 is continually moved from bench entry 38 toward heading entry 40, removing mined material by vehicle 76 to portable crusher (not shown) to conveyor 56.

In an alternate embodiment, conveyor belts (not shown) may be located in adjacent lanes 32 and may be used in conjunction with a portable crusher (not shown). Vehicle 76 may load mined material in one lane 32, haul it through crosscut 34 and dump it into a portable crusher located in an adjacent lane 32 or several lanes away. In operating in this manner, productivity of vehicles 58 and 76 is increased.

Figure 4:
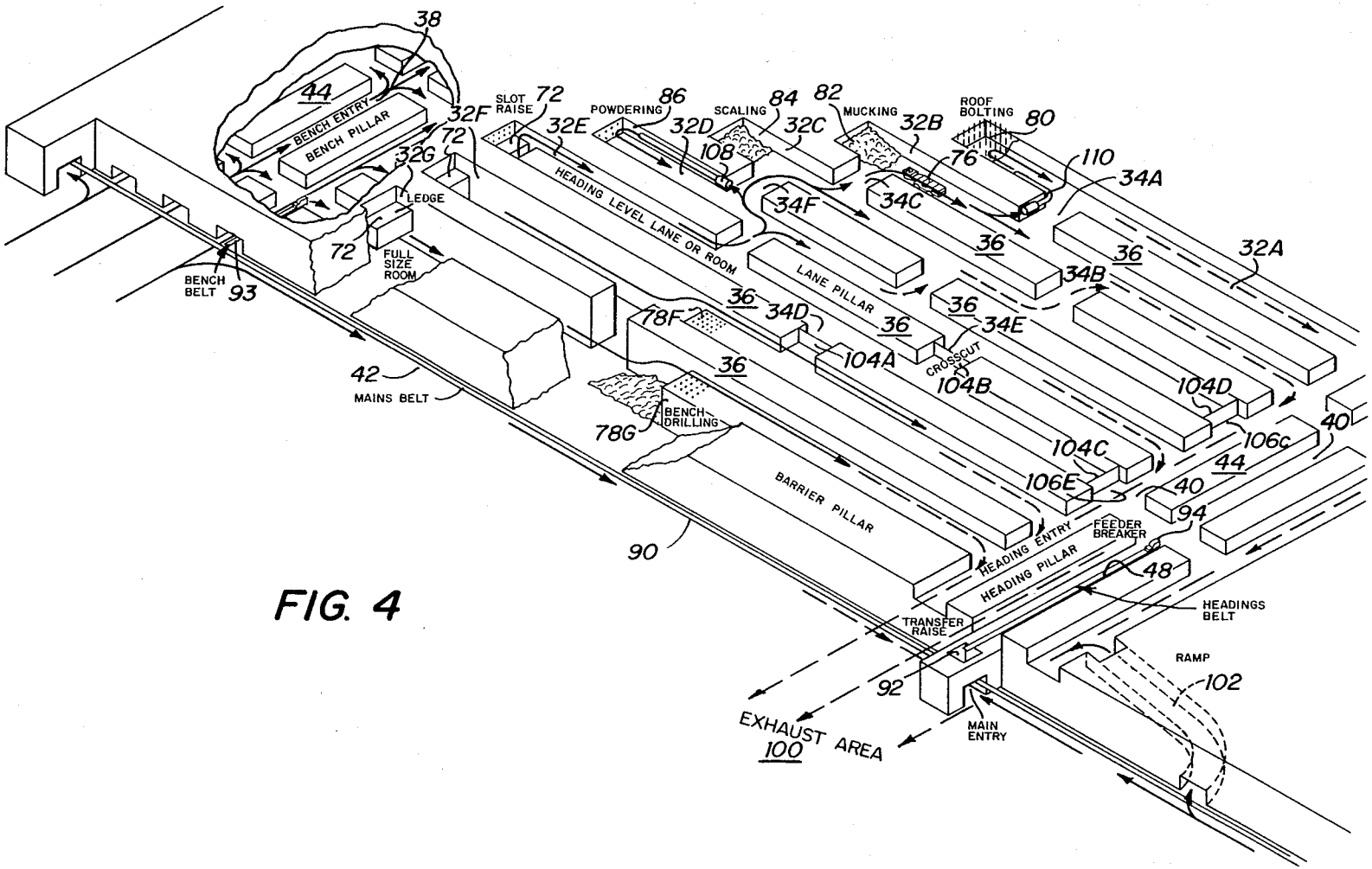
FIG. 4 is a partially cutaway isometric view of the operation of FIG. 2.

In FIG. 4 a perspective view of the mining operation of the present invention is illustrated. In lane 32A, the heading level is illustrated as having progressed past crosscut 34A and roof bolting is occuring at 80. Mining of lanes 32 may be done by any mining practice in use in the art. However, the preferring embodiment uses a method wherein the mine face is drilled, blasted and the mined material removed. The walls and roof of lanes 32 are scaled to provide a generally even surface with a minimum of loose rocks.

In lane 32B, mining has progressed past crosscuts 34A, 34B and 34C nad mucking or material removal is illustrated at 82. In lane 32C, scaling of the lane walls before and during mucking is illustrated at 84.

In lane 32D, powdering is ilustrated at 86 in preparation for blasting the lengthen lane 32D towards bench entry area 38. Lane 32E is illustrated as having slot raise 78 completed (see FIG. 3C) and mining from bench entry 38 level may commence. In lanes 32E, 32F and 32G, ledge 72 is illustrated as extending out from the bench level 38 to end below their respective heading entry area 32 levels.

The mining process begins with providing main entry area 42. A main conveyor belt 90 is placed in main entry area 42 when a transfer raise 92 for rock has been provided to connect main entry area 42 with heading entry area 40. The unloading from bench belt 93 and headings belt 94 includes cascading material through transfer raise 92 onto main entry conveyor belt 90 in the case of headings belt 94 and unloading bench belt 90 in the case of headings belt 94 and unloading belt 93 directly onto main entry conveyor belt 90 in the case of bench belt 93. The flow of the material is directed and controlled onto main entry conveyor belt 90 by means of chutes or regulated feeders (not shown) in both instances.

Bench area 38 and heading entry area 40 are provided simultaneously in the preferred embodiment, although their exact sequence may be as desired. Lanes 32 are mined at the heading entry area 40 level. Access ramp 102 is driven from mains area 42 to facilitate initial development of heading entry area 40. Mined material is loaded on vehicle 76 and transported to transfer raise 92. The crushed material is dumped through transfer raise 92. The crushed material is dumped through transfer raise 92 and loaded onto main entry conveyor belt 90, where it is transported to the surface for further processing. Lanes 32 are generally perpendicular to heading entry 40 and extend toward bench entry 38. Lanes 32 are mined at a level equal to the level of heading entry 40. Prior to extending bench entry area 38, the heading entry 40 level of lane 32 is connected to the start of a bench entry 38 level of lane 32 by drilling from heading entry 40 level to bench entry 38 level. The drilled holes are blasted (see FIGS. 3B and 3C) to provide a slot raise. In the preferred embodiment, the distance from the top of lane 32 to floor 54 of heading entry 40 level is approximately one third of the distance from the top of lane 32 to the bottom or floor level of bench entry 38. However, any ratio of bench entry 38 mined area to heading entry 40 mined area may be used, the basic principle being a mining system, with mining being done from both bench entry 38 and heading entry 40. This alleviates logistical problems associated with a single access to a multiple operation area by providing separate access to both portions of the mining extraction process.

Heading entry 40 and heading level lanes 32 are done first to permit mining to connect to bench entry 38. Furthermore, the connection through the slot raise 78 allows fresh or intake air to be easily circulated to the area surrounding mining face 78 without the requirement of large air blowers or circulating pumps.

Referring to FIG. 4, the air ventilation system is illustrated as having solid lines with arrows indicating intake air and broken lines with arrows indicating exhaust air. Intake air enters through bench entry area 38 and enters the mining area through lanes 32E, 32F and 32G. Air entering in lane 32G is permitted to travel towards heading entry 40 across bench face 78G and out through exhaust area 100. Similarly, air entering lane 32F is permitted to travel across face 78F through heading entry area 40 and out through exhaust area 100. Air entering slot raise 72 into lane 32E by brattices 104A, 104B and 104C blocking crosscuts 34D and 34E and lane entry area 106E respectively. Since no mining is being done in lane 32E, no air flow is required to remove mining dust, gases or diesel fumes from vehicles 76.

At bench entry 38 end of lane 32D powdering is being conducted and air flow is necessary for the work area at 86. Blower 108 is used to force intake air towards powdering work area at 86. The exhaust air then travels down lane 32D toward heading entry area 40 and out through exhaust area 150.

Intake air also travels through crosscut 34F to scaling area at 84. The exhaust air travels partially down lane 32C to crosscut 34B since brattice 104D prevents air flow through entry area 106C to heading entry area 40 through lane 32C. A portion of the intake air flows to mucking area at 82 through crosscut 34C and is exhausted down lane 32B. A final portion of the intake air travels through crosscut 34A to roof bolting area at 80 by blower 110 and is exhausted down lane 32A.

Blowers 108 and 110 are used since their respective work areas are a significant distance from the source of intake air at the crosscuts. Blowers are not used in lanes 32B and 32C since their respective work areas are relatively close to intake air at crosscuts 34C and 34F respectively. However, on occasions blowers may be required. Blowers are also used in lanes with a large cross section to prevent stratification of gases in the mine atmosphere.

The mining method of the present invention is performed by excavating main entry area 42 and providing it with a main conveyor belt 90.

Heading entry 40 is mined, the material being removed on conveyor 48 and loaded on conveyor 90 through transfer raise 92. Bench entry areas 38 is completed, the material mined being removed on conveyor 56 and loaded on conveyor belt 90. Before removal by either conveyor, mined material goes through portable crushers for reduction to a size that can be easily handled by the conveyors. The upper level of lanes 32A through 32C are mined from heading entry 40 towards bench entry 38. Slot raise 74 is driven to connect the bench entry 38 level of the mine to the completed upper level of lanes 32A through 32G to create mining face 78. Mined material from face 78 is transported by load-haul-dump (LHD) vehicles 76 to conveyor belt 56, which in turn loads onto conveyor belt 90 for further processing. Conveyor belts may be placed in lanes adjacent to the one being mined to reduce the transporting distance required by vehicles 76.

Brattices, such as brattices 104A through 104D, may be put in position to direct the flow of intake air flowing from bench entry 38 to heading entry 40. Additional blowers 108 and 110 may be used to direct intake air where necessary.

While the present invention has been described by way of a preferred embodiment illustrating a small mining system, it is to be understood that it should not be limited thereto but only by the scope of the following claims:

What is claimed is:

1. A method for mining a body of material occurring in generally horizontal subsurface formations comprising the steps of:

excavating a main entry in juxtaposition with the body of material;

excavating a heading entry perpendicular and connected to said main entry at one level;

excavating a bench entry perpendicular and connected to said main entry and parallel to said heading entry at a second level;

excavating a first plurality of lanes from said heading entry to said bench entry at said one level;

removing the material from said first plurality of lanes;

excavating a second plurality of lanes from said bench entry to said heading entry at said second level, said second plurality of lanes being located below said first plurality of lanes;

removing the material from said second plurality of lanes through said bench entry; and connecting said first plurality of lanes and said second plurality of lanes.

2. The method according to claim 1 wherein said connecting step includes the step of:

driving a vertical slot raise to create a bench face.

3. The method according to claim 1 wherein said step of removing material from said first plurality of lanes includes the steps of:

placing the material on a load-haul-dump vehicle;

unloading said vehicle on a portable crusher;

loading the material on a first conveyor belt located along said heading area from said portable crusher; and unloading said first conveyor belt onto a second conveyor belt located in said main entry area.

4. The method according to claim 1 also including the step of forming a ledge between said first plurality of lanes and said second plurality of lanes next to said bench entry for sealing said second plurality of lanes when material removal is complete.

5. The method according to claim 4 wherein said sealing to be accomplished by blasting down said ledge to form a seal between said lanes and said bench entries.

* * * * *